US008794597B1

(12) United States Patent
Ingesson et al.

(10) Patent No.: US 8,794,597 B1
(45) Date of Patent: Aug. 5, 2014

(54) BREACHING TOOLS FOR ENTRY OF DOORS AND WINDOWS

(75) Inventors: Lars Ingesson, Hollviken (SE); Patrik Gustavsson, Bunkeflostrand (SE)

(73) Assignee: 5.11 Inc., Modesto, CA (US)

( * ) Notice: Subject to any disclaimer, the term of this patent is extended or adjusted under 35 U.S.C. 154(b) by 159 days.

(21) Appl. No.: 13/199,603

(22) Filed: Sep. 2, 2011

Related U.S. Application Data

(60) Provisional application No. 61/402,741, filed on Sep. 3, 2010.

(51) Int. Cl.
*B66F 3/00* (2006.01)
*B66F 15/00* (2006.01)

(52) U.S. Cl.
USPC ..... 254/131; 254/25; 254/104; 7/166

(58) Field of Classification Search
USPC ..... 254/21, 25, 19, 28, 93 R; 269/3, 6; 7/166, 143
See application file for complete search history.

(56) References Cited

U.S. PATENT DOCUMENTS

| | | | | | |
|---|---|---|---|---|---|
| 4,685,213 | A * | 8/1987 | Powers | 30/123 |
| 5,695,172 | A * | 12/1997 | Hreha | 254/25 |
| 6,131,488 | A * | 10/2000 | Coonrad | 81/20 |
| 6,311,537 | B1 * | 11/2001 | Vigil | 72/392 |
| 7,503,545 | B2 * | 3/2009 | Verbowski | 254/25 |
| 7,634,830 | B2 * | 12/2009 | Ryan | 7/166 |
| 8,393,596 | B2 * | 3/2013 | Lindskog | 254/104 |

FOREIGN PATENT DOCUMENTS

| | | |
|---|---|---|
| EM | 000840681-000 1 | 12/2007 |
| EM | 000840681-000 2 | 12/2007 |
| EM | 000840681-000 3 | 12/2007 |
| EM | 000840681-000 4 | 12/2007 |
| WO | WO 2009089913 A1 * | 7/2009 |

* cited by examiner

*Primary Examiner* — Lee D Wilson
*Assistant Examiner* — Nirvana Deonauth
(74) *Attorney, Agent, or Firm* — Thomas M. Freiburger

(57) ABSTRACT

A breaching tool for use by law enforcement or emergency personnel has a curving, tapered wedge at a first end, extending approximately perpendicularly from a tool handle, and providing a striking surface for driving the wedge between a door and door frame, for example. At an opposite end is a tapered chisel tail end, preferably with a claw for pulling nails or other fasteners. The tool may include a loop handle, generally in a trapezoid configuration connected to the main tool shaft, for manipulating the tool in service.

8 Claims, 3 Drawing Sheets

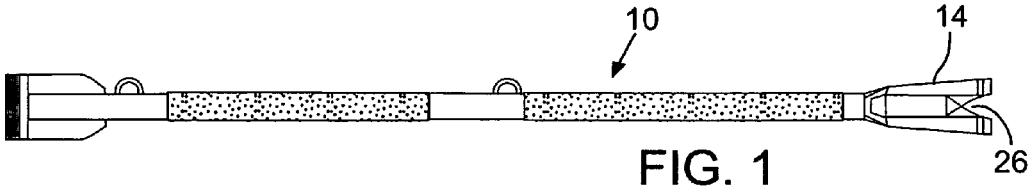
FIG. 1
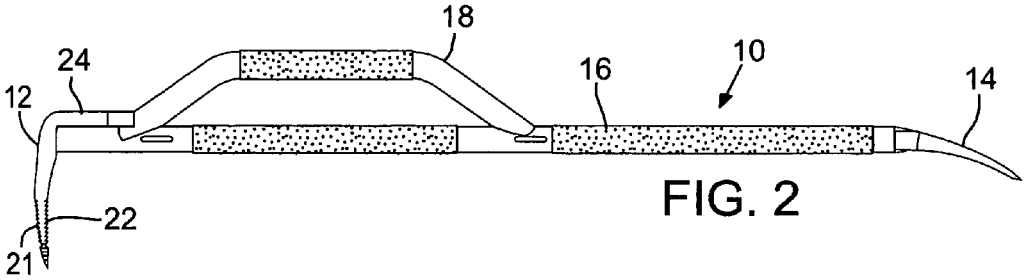
FIG. 2
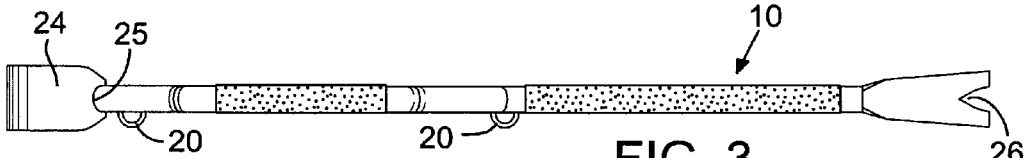
FIG. 3
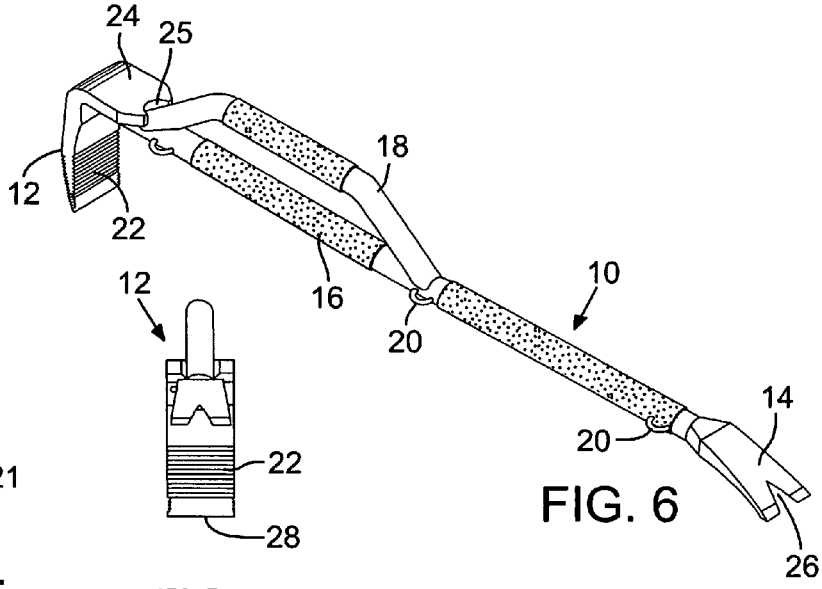
FIG. 6
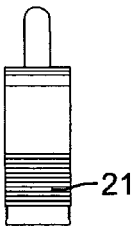
FIG. 5
FIG. 4

BREACHING TOOLS FOR ENTRY OF DOORS AND WINDOWS

BACKGROUND AND SUMMARY OF THE INVENTION

This application claims benefit from provisional patent application No. 61/402,741, filed Sep. 3, 2010.

This invention concerns tools for forced entry of a building, primarily for forcing open doors and windows, the tools typically being used by law enforcement and military tactical teams, search and rescue teams and fire fighters.

Breaching tools are known, including those produced by Sweden Entry Tools of Malmo, Sweden. The tools are usually at least several feet long and are heavy enough to act as levers to pry open a door or other entry using a short head or prying end which is generally at right angles to the length of the tool. Sometimes the tools have been formed into a chisel shape at the other end, and opposite the tool head, with some curvature to the chisel, also for prying purposes.

The current invention improves on the prior tools by providing features which make the entry tools more efficient, versatile and quickly used in breaching a door. These improvements include an improved tail end on the tool, where the chisel is combined with a nail puller, as well as other improvements. These and other objects, advantages and features of the invention will be apparent from the following description of a preferred embodiment, considered along with the accompanying drawings.

DESCRIPTION OF THE DRAWINGS

FIG. 1 is a bottom plan view showing a first embodiment of a breaching tool.

FIG. 2 is a side elevation view of a breaching tool.

FIG. 3 is a top plan view of the breaching tool.

FIG. 4 is an end view of the tool as viewed from the tail end of the tool.

FIG. 5 is a end view as viewed from the head end of the tool.

FIG. 6 is a perspective view showing the tool of FIGS. 1-5.

DESCRIPTION OF PREFERRED EMBODIMENTS

Figure 7:
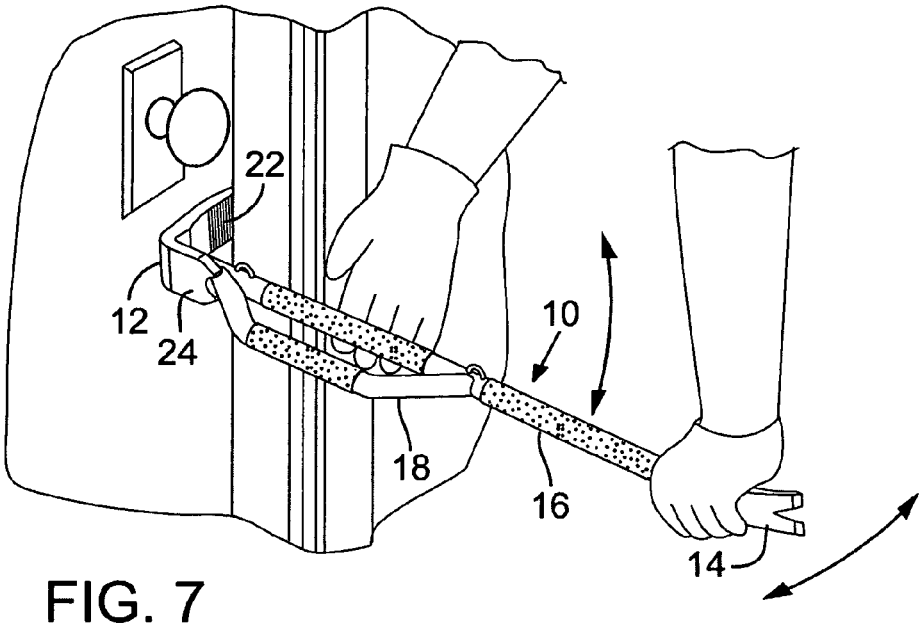
FIG. 7 is a photograph showing the tool in use on an inwardly-swinging door.

The breaching tool 10 of FIGS. 1-6 is a heavy duty entry tool, and may be approximately three feet in length, or approximately 872 mm. The length can be in the range of about 32 to 37 inches. The tool has a head 12 at head end and a tail end or chisel 14 at the opposite end. The shaft or main handle 16 of the tool extends between the head and tail. Also preferably included is a looping bar handle 18 that extends out from the shaft 16 preferably as shown, which can be in a trapezoid configuration with the handle 16. The tool may also include two metal loop eyes 20 to which a carrying sling can be attached.

The breaching tool 10 is designed so that the tool can open both inward and outward swinging doors. The tool is particularly advantageous with metal and security doors.

The tool head 12 is made from a high strength steel and is of a special design. For outward swinging doors (wood, security and metal doors), the head has a specific curving wedge shape, so that when the tool is pressed between a door and frame, the door and frame are pressed apart so that the lock cylinders are accessible. For this reason the breaking force to open the door is reduced, as the tool itself separates the door and its frame regardless of the lock system. The tool head can be driven into the space between the door and frame so that sharp edge of the wedge penetrates the space, along the edge of the door. The curve in the head 12 allows that as the tool is pressed inward between the door and the frame, the head follows the door's edge and works its way behind the door, rather than simply being engaging into the door's frame.

Further, as seen in the drawings, the front and back sides 21 and 22 of the tool's head are knurled, preferably with parallel grooves as shown, to stabilize the tool as it is being inserted, so that the tool does not slip out while being struck to drive it between the door and the frame. Once the head is fully inserted, the tool 10 can be used to pry the door outwardly. As the breaching tool is used, the looping bar handle 18, which will be extending to one side during the breaching operation, can be used to hold the tool in a horizontal position as another person strikes the head to drive it inwardly. Also, the handle 18 strengthens the tool and offers protection from pinching or crushing injuries on the hand as the tool is used.

The width of the tool head 12 preferably is about 2.4 inches, i.e. about 60 mm. The weight of the tool is preferably in the range of about eight to ten pounds, and may be about nine pounds.

Another preferred feature is that the tool shaft 16 and the loop handle 18 preferably have knurled surfaces, as indicated, for better gripping. The knurling is present preferably at least in the forward region of the shaft 16 and on the loop handle 18.

In a preferred embodiment the tool head 12 is formed separately from the shaft 16 and is welded securely to the forward end of the shaft, in the position shown. Preferably the L-shaped head 12 is welded to the main portion of the tool at several locations for maximum strength: at the forward end of the shaft or main handle 16, as well as where a striking plate 24 of the head meets the shaft 16 and at the rear of the plate 24, which preferably is curved as shown at 25 to accommodate welding of the plate 24 to the loop handle 18 and/or to the shaft 16.

The tail end 14 of the tool is formed as a chisel as discussed above. The chisel end preferably is curved as shown, and an important feature about the tip of the chisel is fashioned into a claw 26. The curve in the chisel end 14 is useful especially in prying open inwardly swinging doors. The claw end 26 does not inhibit use of the chisel end but additionally allows the tool to be used to pull nails, screws or other fasteners as needed.

The tool head 12 is an important feature of the breaching tool 10. Its striking plate 24 at the top side is strongly dimensioned and preferably of high strength steel. This striking plate presents a surface which is easy to hit when striking the tool with a sledge hammer or similar tool, to drive the wedge end of the head between the door or window and a frame. The thickness of the head, above the wedge end, is kept at minimum, using high strength steel, to allow the head to penetrate more easily between the door and frame. Preferably the head thickness above the wedge end or tip 28 tapers up to a maximum of about 20 mm (⅞ inch), or no more than about 24 mm.

Figure 8:
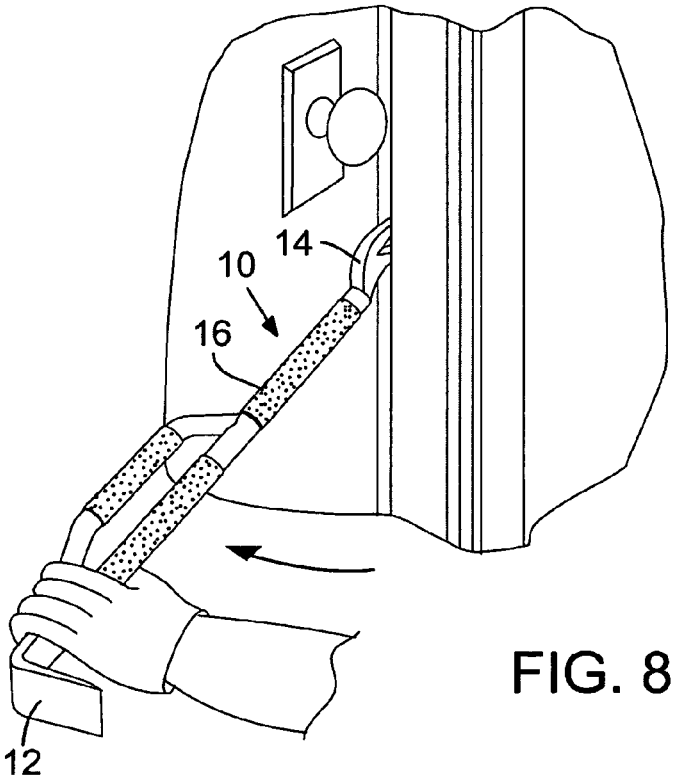
FIG. 8 is another photograph showing the tool breaching an inwardly-swinging door.
Figure 9:
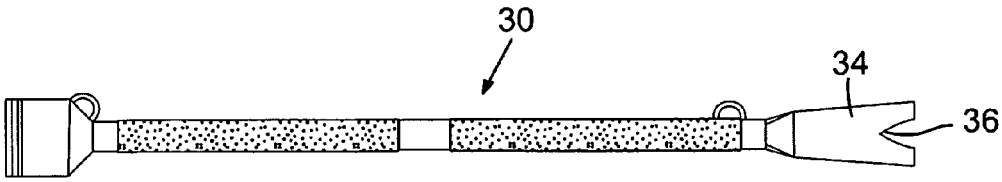
FIG. 9 is a bottom plan view showing another embodiment of a breaching tool, somewhat lighter-duty than the first.
Figure 10:
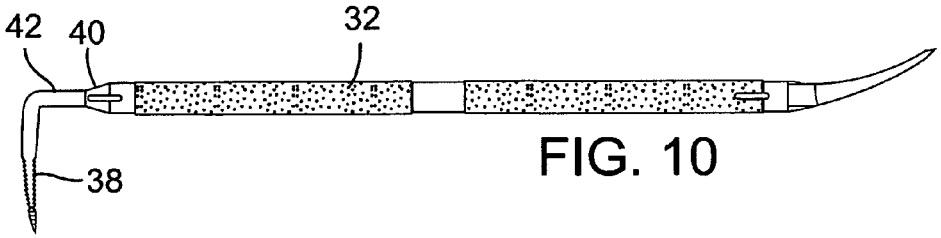
FIG. 10 is a side elevation view of the tool of FIG. 7.
Figure 11:
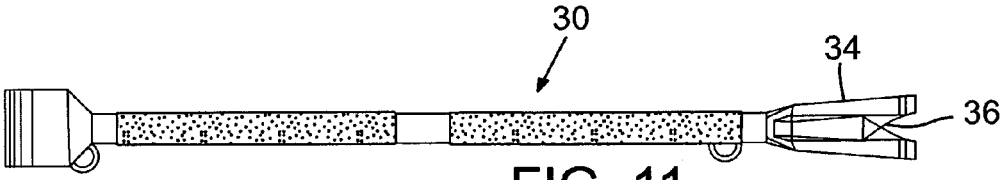
FIG. 11 is a bottom plan view of the tool.
Figure 14:
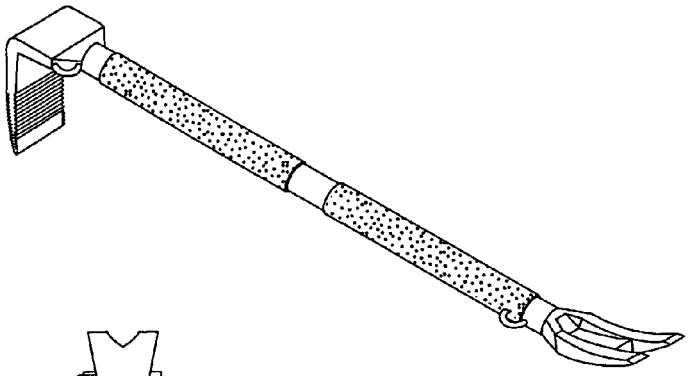
FIG. 14 is a perspective view showing the breaching tool of FIGS. 7-11.
Figure 13:
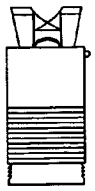
FIG. 13 is an end view as viewed from the head end of the tool.
Figure 12:
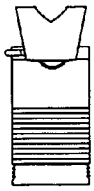
FIG. 12 is an end view of the tool as viewed from the tool's tail end.

Once the tool head has been engaged between the door and the frame of an inwardly-swinging door, as shown in FIG. 7, the user of the tool can rotate the tool handle up or down, prying the door away from the frame with a very strong leverage. When this has been done at several locations up and down the door frame, the door can usually be breached very quickly (if this has not occurred already) by prying with the head by moving the tool handle in a horizontal plane from the position shown in FIG. 7, near the lock, or by using the chisel end of the tool as indicated in FIG. 8. The head will separate an outwardly-swinging door from the frame, primarily because of the width of the head, and the lock will jump out of its position or bend or break due to the extreme force applied. Because of the head 12 and its construction, the tool has the multiple functions of prying an outwardly swinging door by two types of prying motion, and quickly penetrating the jamb space of an inwardly-swinging door and following the door edge to work its way behind the door, as well as use of the chisel end and the fastener pulling claw at that end.

FIGS. 9 through 14 show another embodiment of a breaching tool for efficient entry of doors and windows. This is a lighter and somewhat smaller tool than the tool 10 described above; it may be approximately five pounds (range of about 4 to 6 pounds) as compared to about nine pounds (range of about 8 to 10 pounds) for the heavier duty tool of FIG. 1, and with a length of about 0.7 meter, i.e. a little over two feet, preferably about 28 inches (range of about 25 to 30 inches). This tool 30 can be used in combination with the heavier-duty tool for breaching inwardly-swinging doors. The breaching tool 30 has a handle or shaft 32, without the looping handle shown in the heavy duty model, and has a tail formed into a chisel 34, preferably with a claw 36 for pulling nails or screws, similar to the tail of the tool described above. The main difference between this tool 30 and the heavier-duty tool 10 is in the tool head 38, which is much lighter than that of the heavy duty tool. From the drawings it can be seen that the head 38, although having a similar shape to the head 12 of the other tool, is considerably thinner and lighter in profile, and is secured to the handle or shaft 32 by a simpler fastening and welding arrangement, at 40, where the head flange 42 is in planar alignment with the shaft or handle 32 and does not provide as significant a striking plate as in the larger tool 10, although it does act as a striking plate. Whereas the heavy duty tool 10 can be used to separate the door from the frame and to quickly breach the door due to the heavy construction and its very solid connection to the handle, the breaching tool 30 cannot do this to the same extent, especially on steel and other heavily reinforced doors, so more force generally must be used when breaching the door using the tool 30.

The lighter-duty breaching tool 30 is light and small enough to be conveniently carried in a patrol car, and is useful for virtually all kinds of doors including both ingoing and outgoing wood and steel doors. With the tool 30 one cannot breach a door as quickly and forcefully as with the heavy duty tool 10, but this tool does have advantages in its weight and size; it is easier and lighter to bring along to the place where needed. It also has the features of a curving wedge on the head and preferably includes grooved or knurled surfaces at front and back of the wedge, as in the larger tool, and a claw at the tail end of the tool. Note also, the lighter tool 30 can be used along with the heavier tool 10. The heavy tool can be used to open a gap between the door and the frame large enough for the tail end of the lighter tool to be inserted in and around the frame to assist with the breaching of ingoing doors. The two tools can comprise a breaching tool kit.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A breaching tool for forcing open a door or other entry, comprising: an elongated, generally straight shaft, a head of high strength steel on one end of the shaft, the head having a curving, tapered wedge extending angularly from the shaft and configured to be forced between a door and a door frame, the wedge having front and back sides both knurled for better gripping of door and frame surfaces, and the head including a striking plate connected to the wedge and having a striking surface generally perpendicular to a direction of extension of the wedge so as to enable driving the wedge between a door and a frame by striking the striking plate with a hammer, at an opposite end of the shaft, a chiseled tail of tapered configuration, the chiseled tail having a split outer end to form a claw or nail puller, and a loop handle connected to the shaft, near said one end and extending from the handle shaft in a direction opposite that of the wedge, both the loop handle and the shaft adjacent to the loop handle being knurled for better gripping by a user, said shaft including a first metal loop eye at the one end of the shaft adjacent a first end of the loop handle and a second metal loop eye on the shaft located at an opposite second end of the loop handle, both first and second loop eyes located on a same side of the shaft and extending in a same direction perpendicular to the direction in which the loop handle extends and positioned for attachment of a carrying sling.

2. The breaching tool of claim 1, wherein the loop handle is positioned just behind the striking plate on the tool and is in a generally trapezoid configuration with the shaft.

3. The breaching tool of claim 1, wherein the wedge and the striking plate are integral with one another forming generally an L-shaped head, the striking plate being secured on an upper side of the shaft, with an end of the shaft essentially abutting against an upper portion of the wedge, and the L-shaped head is secured to the shaft by welding of the wedge to said end of the shaft and welding the striking plate to the shaft or to the loop handle.

4. The breaching tool of claim 1, wherein the tool head has a width of about 2.4 inches.

5. The breaching tool of claim 1, wherein the tool has a length of about 3 feet.

6. The breaching tool of claim 1, wherein the tool has a length in the range of about 33 to 37 inches.

7. The breaching tool of claim 6, wherein the tool has a weight in the range of about 8 to 10 pounds.

8. The breaching tool of claim 6, wherein the tool has a weight of about 9 pounds.

* * * * *